United States Patent [19]

Inskip

[11] 4,023,465

[45] May 17, 1977

[54] FIREARM

[76] Inventor: Thomas C. Inskip, 6504 Democracy Blvd., Bethesda, Md. 20034

[22] Filed: June 27, 1975

[21] Appl. No.: 555,585

[52] U.S. Cl. ..... 89/131; 89/142

[51] Int. Cl.[2] ..... F41D 11/02

[58] Field of Search ..... 89/131, 129, 136, 142

[56] References Cited

UNITED STATES PATENTS

| | | | |
|---|---|---|---|
| 2,873,650 | 2/1959 | Pinkerton | 89/131 |
| 3,029,708 | 4/1962 | Marchisio | 89/131 |
| 3,236,154 | 2/1966 | Iwashita | 89/131 X |
| 3,251,268 | 5/1966 | Menneking | 89/131 |
| 3,292,492 | 12/1966 | Sturtevant | 89/142 X |
| 3,301,133 | 1/1967 | Sturtevant | 89/131 |
| 3,715,954 | 2/1973 | Rude | 89/131 X |

*Primary Examiner*—David H. Brown
*Attorney, Agent, or Firm*—Cushman, Darby & Cushman

[57] ABSTRACT

An auto-loading firearm has a firing mechanism that selectively permits (1) conventional semi-automatic operation or (2) automatic operation that permits bursts to be fired at a rate which can be varied between 1 and about 12 rounds per second in response to the finger pressure on the trigger, without release of the trigger or adjustment to the firearm. The mechanism for accomplishing variable rate of fire includes a cam surface on the bolt carrier which causes the trigger to move forward at one point in the firing cycle, an automatic trigger disengager device pivotally mounted on the frame for coopertion with the trigger, and a trigger depressor device, the mechanism being brought into an operating mode by a manually operated selector lever which has a variable fire position and a safety position. In the event that the variable rate mechanism becomes inoperative, as by breakage of a part the firearm will be fail safe and will operate in the semi-automatic mode. Certain existing firearms can be modified rather easily to include the variable fire rate mechanism, or the mechanism can be incorporated during initial manufacture of the firearm.

9 Claims, 8 Drawing Figures

FIREARM

The present invention relates to a firearm having an improved firing mechanism which allows the operator to control the rate of fire by varying his finger pressure on the trigger during firing.

BACKGROUND OF THE INVENTION

The improved firing mechanism may be incorporated in any of a wide variety of firearms. For purposes of this patent application the invention is described and illustrated in combination with a rifle having a receiver or frame, a gas-operated longitudinally slidable bolt carrier mounted in the frame, a bolt disposed in the carrier, a spring biased hammer engageable with a firing pin in the bolt, and a trigger assembly mounted in the receiver. The forward end of the bolt carrier terminates in a piston residing in a fixed gas cylinder which receives pressurized gas through a port from the barrel of the rifle. When the trigger is forced to the rear by the operator's finger the hammer is released so as to pivot forward and strike the rear end of the firing pin which is thus forced forward into engagement with the primer of a cartridge disposed in a chamber at the rear end of the barrel. Burning of the powder in the cartridge forces the bullet down the barrel past the gas cylinder port, and hot gases pass through the port into the cylinder so as to force the piston, bolt carrier and bolt to begin moving rearwardly. During the initial movement the bolt rotates slightly relative to the frame and carrier so as to become disengaged from locking lugs on the receiver. During continued rearward movement, the carrier strikes and passes over the hammer forcing it to pivot backwards until it is engaged and held in a cocked position by the trigger assembly. The front end of the bolt in succession pulls the empty shell from the chamber and ejects it from the rifle. The carrier then strikes the rear of the receiver and stops. A longitudinally disposed spiral spring having its rear end fixed with respect to the receiver and its front end engaged with the carrier is compressed by the rearward movement of the carrier. As soon as the carrier is stopped by striking the receiver the spring begins to force the carrier forward. As the carrier moves forward the bolt picks up a fresh cartridge from a magazine or clip and moves the fresh cartridge into the chamber. The bolt engages cam surfaces on the carrier causing the bolt to rotate in the carrier and become locked in the receiver against rearward movement. The carrier moves slightly forward thereby rendering the trigger mechanism functional, in the sense that the mechanism is now permitted to operate in its intended manner.

All of the above is broadly conventional in automatic and semi-automatic firearms and need not be described or illustrated in detail in the present patent application. Accordingly, the drawings are limited to the details of the special firing mechanism which is the subject of this invention, with the conventional features being either omitted or illustrated schematically. More in particular, the described and illustrated rifle is a modified rifle of a known basic design, specifically a Soviet military weapon, known as an AK-47, which is selectively operable in either a semi-automatic or a full automatic (constant rate of fire) mode. The unmodified rifle is fully described in a publication entitled "The AK-47 Assault Rifle" edited by Wyant La Mont (Normount Technical Publications, Wickenburg, Ariz., Copyright 1969 by Donald B. Mclean). A further existing firearm which is readily modified to incorporate the present invention is the M62/s, a Finnish military rifle.

Firing mechanisms for changing the rate of fire in automatic firearms, by creating a delay in the operation of the mechanism, are disclosed in U.S. Pat. Nos. 3,015,993, 3,029,708 and 3,236,154.

SUMMARY OF THE INVENTION

The present invention provides a firing mechanism which effects variable rates of fire in response to the operator's finger pressure on the trigger. This is accomplished primarily by means of a special delay characteristic achieved by positively and rapidly kicking the trigger in a forward direction against the operator's finger pressure after each round is fired and by locking the trigger in this forward position until another round has been locked in the chamber. The kicking action of the trigger against the operator's finger increases the time required for the finger pressure to move the trigger again to its firing position. This delay is greater when finger pressure is reduced, and as a result the operator can control the rate of fire with his trigger finger. The kicking action is achieved in the preferred embodiment by means of a trigger depressor element which upon pulling of the trigger moves into the path of the bolt carrier so as to be struck by the latter during its rearward movement and be forced against the trigger.

DETAILED DESCRIPTION

Figure 1:
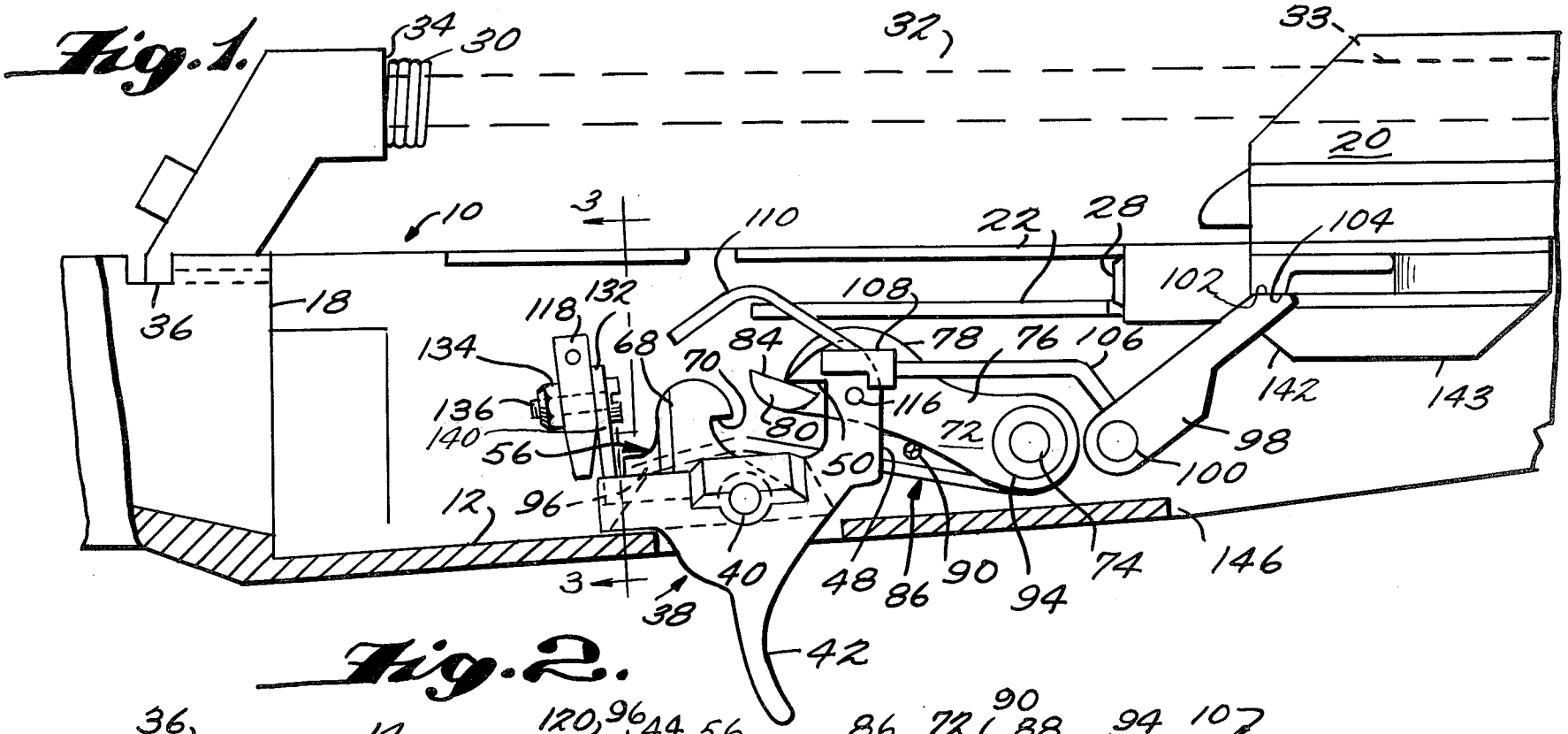
FIG. 1 is a vertical sectional view of the receiver portion of a rifle embodying the principles of the present invention, showing the firing mechanism cocked and ready for firing in a variable rate mode.
Figure 2:
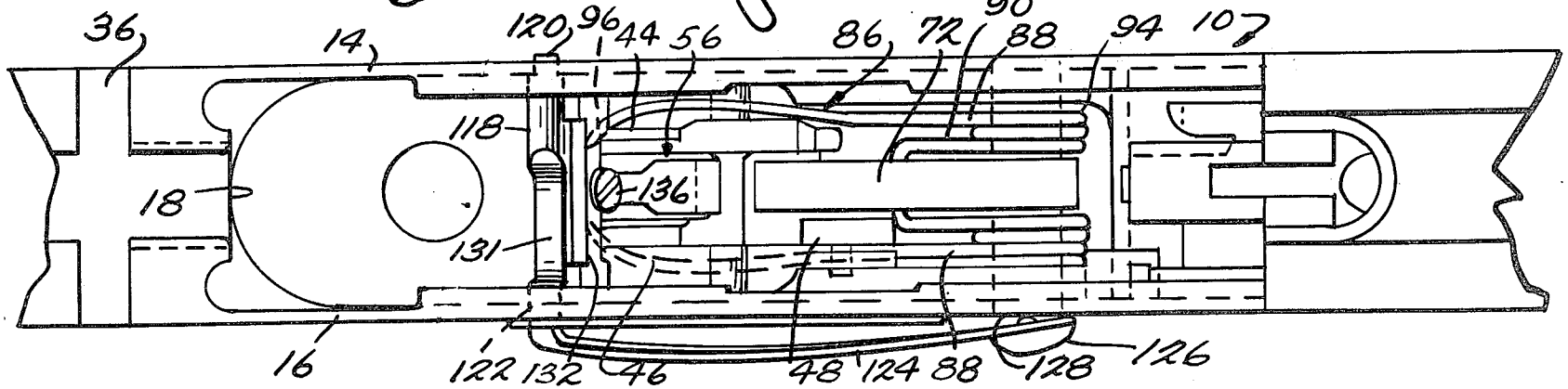
FIG. 2 is a plan view of FIG. 1.
Figure 3:
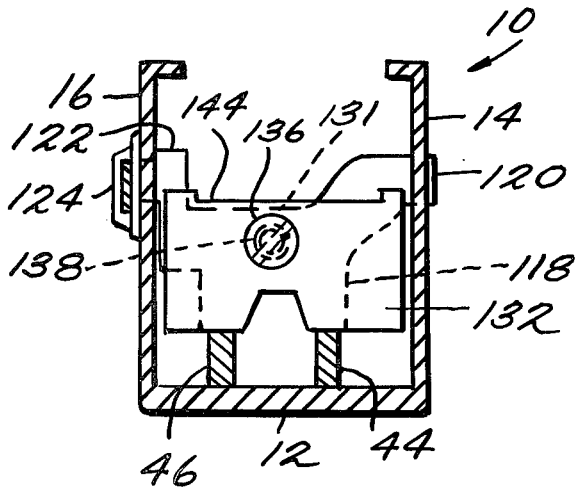
FIG. 3 is a sectional view taken on the line 3—3 of FIG. 1.

Referring to FIGS. 1 and 2 there is shown in vertical section the receiver portion of a rifle embodying the firing mechanism of the present invention. All the parts of the rifle which are not illustrated may be conventional.

The rifle includes a channel-shaped receiver 10 having a bottom wall 12, left and right side walls 14 and 16, and a rear wall 18. Longitudinally slidable in the upper portion of the receiver 10 is a bolt carrier 20 or slide which is supported by means of conventional ribs 22 or flanges projecting from the inner surfaces of the side walls 14 and 16. A bolt 24 is carried in a recess in the lower end of the carrier 20 for limited longitudinal and rotative movement relative to the carrier 20, as is conventional. A longitudinally moveable firing pin 28 is disposed within the bolt 24. A gas-operated piston (not shown) is connected to the right hand end (not shown) of the bolt carrier 20 to move the latter rearwardly immediately upon firing of a cartridge. A spiral return spring 30 returns the carrier 20 to its forward locked position after firing. The spring 30 is mounted on a fixed rod 32 which is received into a bore 33 in the carrier 20 during rearward movement of the latter, the spring 30 being compressed between the carrier 20 and a stop 34 on the rod 32 during such movement. The rear end of the rod 32 is releasably latched into a notch 36 in the receiver 10 so that the rod 32 and spring 30 may be manually removed during disassembly of the rifle.

The trigger assembly includes a trigger 38 pivotally mounted to the receiver 10 by means of a pin 40 and having the usual projection 42 for engagement by the trigger finger of an operator. The portion of the trigger above the finger projection 42 is generally channel-shaped in that it has two upwardly projecting parallel bars or ribs 44 and 46 extending longitudinally in the receiver 10. The forward end of the right hand rib 46 terminates in a hook-shaped primary sear 48 having a downwardly and rearwardly facing sear surface 50. The rear ends of the ribs 44 and 46 have downwardly facing stop surfaces 52 which are engageable with the adjacent surface 54 of the bottom wall 12 of the receiver 10 to limit forward movement of the trigger 38.

Between the ribs 44 and 46 of the trigger 38 is a secondary trigger member or sear 56 which is pivotally mounted by the same pin 40 as the primary trigger 38 so as to be movable independently of the latter. The secondary sear 56 is biased forwardly relative to the trigger 38 by means of a spiral compression spring 58 which is retained in a cylindrical recess 60 in the sear 56 and in a generally coaxial recess 61 in the trigger 38. Pivotal forward movement of the sear 56 is limited by engagement of a downwardly facing stop surface 64 on the sear 56 with an upwardly facing portion 66 of the trigger 38. An upwardly projecting hook-shaped portion 68 extends from the body of the secondary sear 56 and provides a downwardly facing sear surface 70.

A hammer 72 is pivotally mounted at its lower end to the receiver 10 by means of a pin 74, for movement between a forward, or fired position and a rearward or cocked position. The hammer 72 includes a body 76 which in the cocked position resides in the space between the ribs 44 and 46 of the trigger 38. In the fired position the forward or striking surface 78 of the hammer 72 engages the rear end of the firing pin 28. A laterally projecting head 80 is provided on the upper end of the hammer body 76. The under surface of the head 80 serves as a forward sear surface 82 for engagement with the sear surface 50 on the primary sear 48 and as a rearward sear surface 84 for engagement with the sear surface 70 on the secondary sear 56.

A hammer and trigger spring 86 serves to swing the hammer 72 forward to its firing position and also to bias the trigger 38 toward a forward cocked position. The spring 86 is a single length of wound 3-strand cable forming two spaced apart generally straight parallel portions 88 which are continuous with a central spring loop 90. The loop 90 presses against the rear surface 92 of the hammer body 76 and during cocking or firing movement of the hammer 72 the loop 90 pivots either rearwardly or forwardly about the hammer pivot pin 74 by virtue of two sets of spring loops 94 which surround the hammer pivot pin 74. The end portions 96 of the cable spring 86 engages the lower rear end portions of the ribs 44 and 46 on the trigger 38 in a manner to bias the latter in a counterclockwise direction as viewed in the drawings.

The firing mechanism also includes a trigger disengagement arm 98 located at the right hand side of the receiver 10 and pivoted at its lower end to the receiver 10 by a pin 100. The arm 98 extends upwardly and forwardly and has a cam surface 102 on its upper end disposed in the path of a cam surface 104 on the bolt carrier 20 so that the arm 98 will be acted on by the cam surface 104 during operation of the rifle. A stiff rod 106 is rigidly connected at its forward end to the arm 98 and rigidly carries at its rearward end a trigger disengagement sear 108. A spring 110 is rigidly attached at one end to the sear 108 and extends upwardly into the path of the bolt carrier 20. The sear 108 has a downwardly facing L-shaped sear surface 112, 114 which, when the arm 98 is pivoted counterclockwise, is engageable with a trigger sear pin 116 projecting laterally from the right hand rib of the trigger 38. When thus engaged with the pin 116 the sear 108 locks the trigger 38. The sear 108 is moved down by engagement of the bolt carrier 20 with the spring 110 when the bolt carrier 20 moves to a rearward position during operation in the variable rate mode.

A further assembly forming part of the firing mechanism includes a selector lug 118 pivotally mounted in the receiver 10 behind the trigger 38 by means of two pin portions 120 and 122 which are mounted in the receiver side walls 14 and 16. The right hand pin 122 is rigidly connected to the rear end of a manually operated selector arm 124 which is disposed outside the right hand receiver wall 16. The forward end of the selector arm 124 is provided with a laterally projecting tab 126 which can be gripped by the fingers of an operator to swing the arm 124 up or down. The inner surface of the arm 124 carries a small projection 128 which snaps into any one of three recesses (not shown) in the outer surface of the receiver side wall 16 in order to latch the arm 124 in an up, intermediate or down position. The firing mechanism is on safety when the arm 124 is in an up position. The intermediate and down positions place the firing mechanism in a variable rate mode and a semi-automatic mode, respectively.

Figure 8:
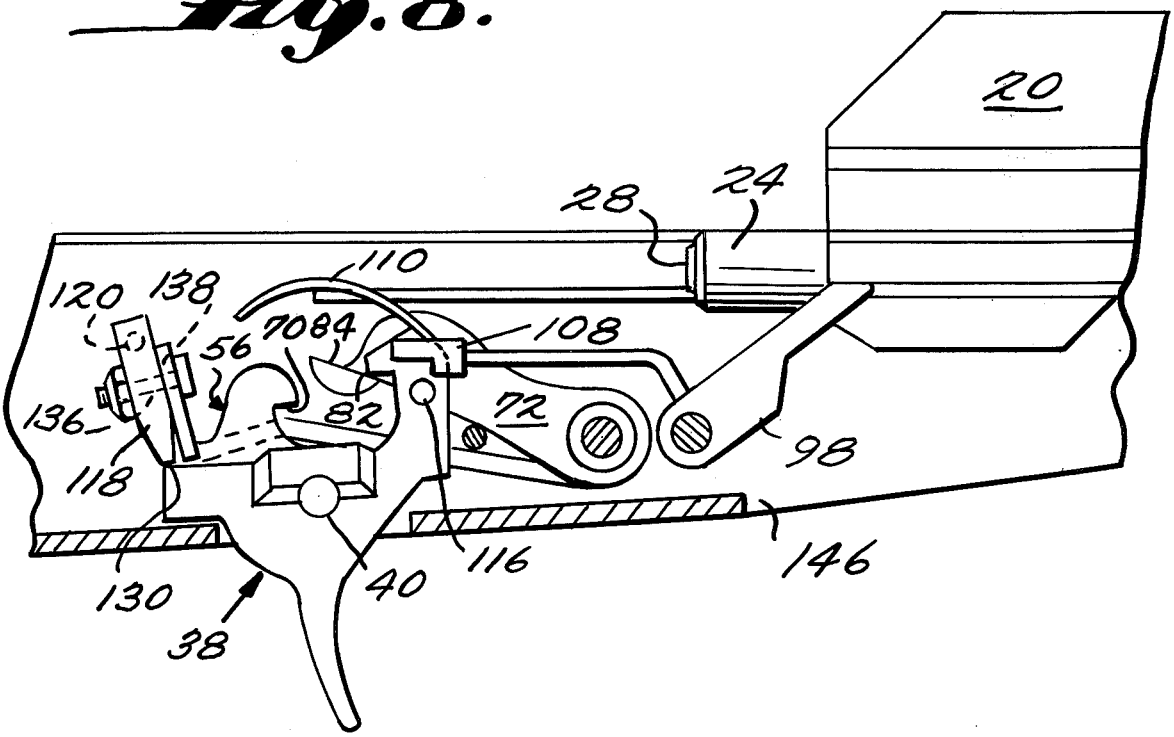
FIG. 8 is a sectional view illustrating the parts when the rifle is on safety.

In the safety position, as seen in FIG. 8, the lower surface 130 of the selector lug 118 overlies the rear portion of the trigger 38 so that the latter cannot be pulled. Movement of the selector arm 124 to either the intermediate or down position swings the lug 118 rearwardly away from the trigger 38. The upper edge of the lug 118 is provided with a notch 131 through which the bolt and bolt carrier pass when moving to and from their full rearward positions.

A trigger depressor plate 132 is loosely carried on the front surface of the selector lug 118 by means of a nut 134 and a bolt 136 which passes through holes in the plate 132 and in the lug 118. The hole 138 in the plate is slightly larger than the shank of the bolt 136 so that slight vertical movement of the plate 132 relative to the lug 118 can take place. Rotation of the plate 132 about the bolt 136 is prevented by sliding engagement of the side edges 140 of the plate 132 with the side walls 14 and 16 of the receiver 10.

Figure 5:
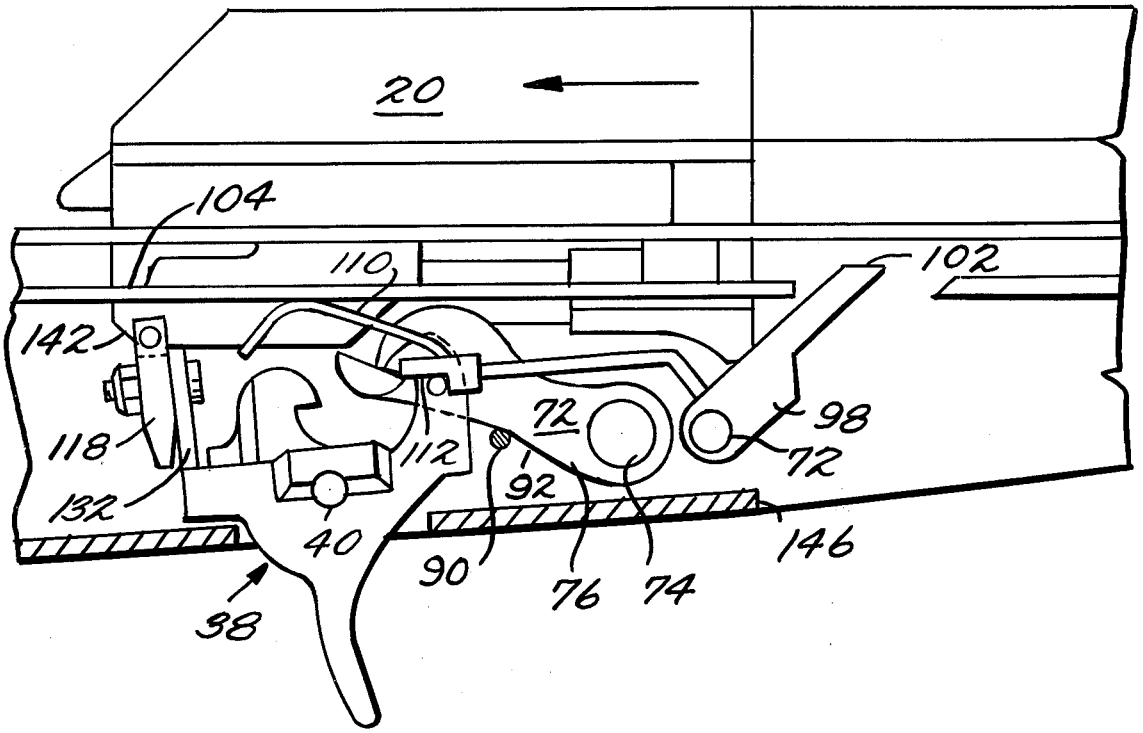
Figure 6:
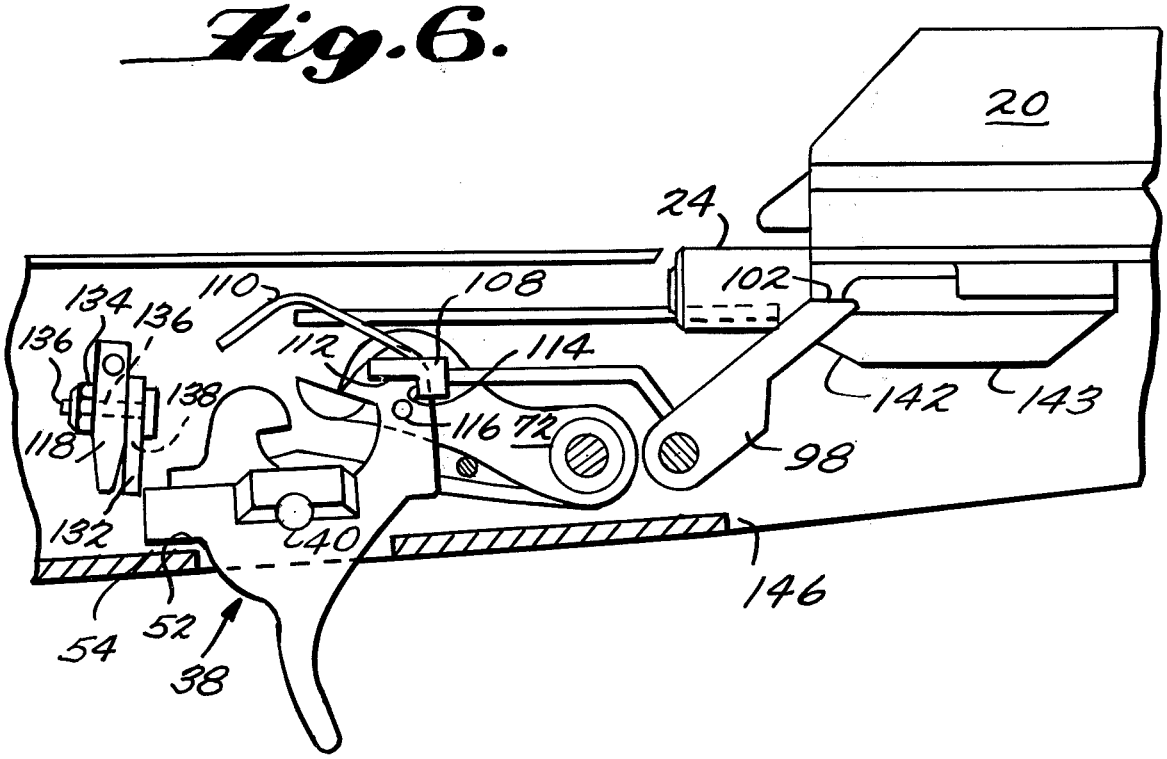
FIGS. 6 and 7 are sectional views illustrating the parts in a semi-automatic mode of fire.
Figure 7:
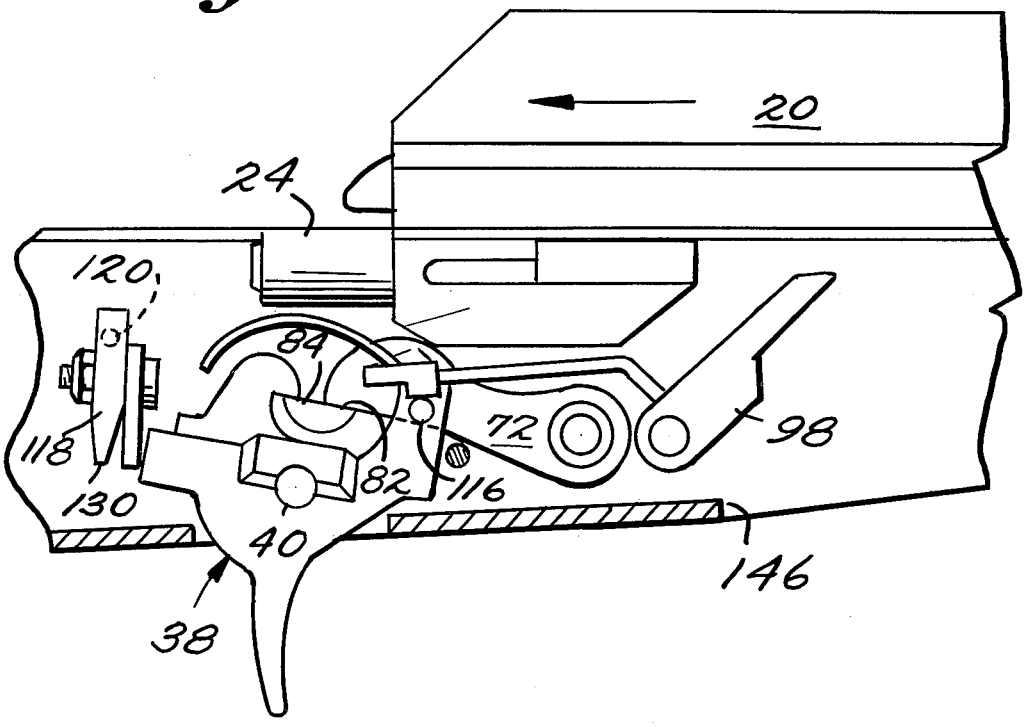

The trigger depressor plate 132 is disposed so that it is non-functional when the selector arm 124 is in either its safety position (FIG. 8) or its semi-automatic position (FIGS. 6 and 7). When the arm 124 is in the intermediate (variable rate) position (FIGS. 1, 4 and 5) the plate 132 is in a position in which it cooperates with the bolt carrier 20 and with the trigger 38. The most important aspect of this cooperation is that in this mode of operation a cam surface 142 on the bolt carrier 20 can strike and pass over the upper edge 144 of the plate 132, causing the plate 132 to move downwardly and thereby kick the trigger 38 slightly forward. Considering this action more in detail it will be seen in FIG. 4 that pulling of the trigger 38 forces the plate 132 upward, as permitted by the loose fit between the plate 132 and the bolt 136. The upper edge 144 of the plate 132 now lies in the path of the cam surface 142 on the bolt carrier 20 so that as the carrier 20 moves rearwardly it cams the plate 132 downwardly against the upper surfaces of the trigger ribs 44 and 46. This forces the trigger 38 to rotate counterclockwise about the trigger pin 40. The rotational force imparted to the trigger 38 is of course stronger than any finger pressure exerted on the trigger 38 in the opposite direction. While the downward force on the plate 132 is generated by the cam surface 142 on the bolt carrier 20 in the illustrated embodiment the same force could equally well be generated by a cam surface on the bolt 24.

OPERATION IN THE VARIABLE RATE OF FIRE MODE

FIG. 1 illustrates the parts in the variable rate mode with the bolt 24 closed and locked and the hammer 72 cocked, the sear surface 50 on the trigger 38 being in contact with the forward sear surface 82 on the hammer 72. The trigger disconnector sear 108 has been raised away from the trigger sear pin 116 by clockwise rotation of the disconnector arm 98 under the action of the cam surface 104 on the bolt carrier 20. When the trigger 38 is pulled the primary trigger sear surface 50 pivots forward about the trigger pin 40 and releases the hammer 72 which then swings forward under the action of the spring 86 and strikes the firing pin 28.

The clockwise pivoting of the trigger 38 causes upward motion of the trigger depressor plate 132 relative to the selector lug 118. When the lower edge of the hole 138 in the plate 132 engages the shank of the bolt 136 the trigger 38 stops.

Figure 4:
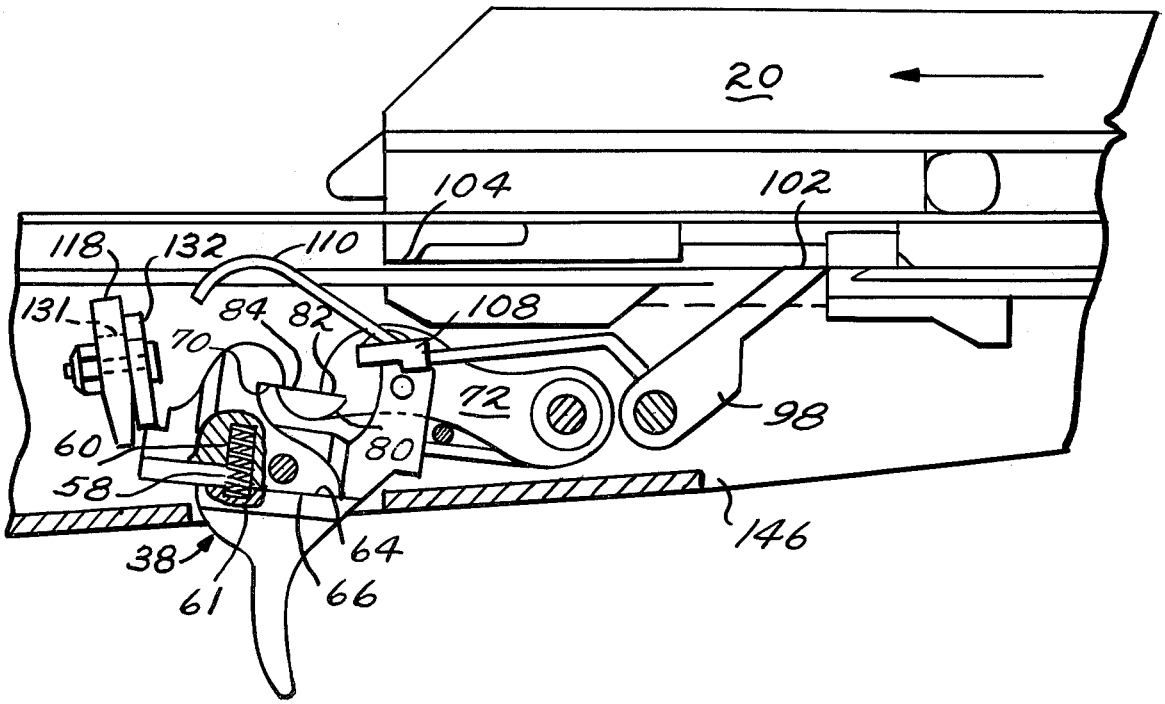
FIGS. 4 and 5 are views similar to FIG. 1 showing the parts in different positions during firing in a variable rate mode.

In FIG. 4, the bolt carrier 20 and bolt 24 have moved rearwardly under the action of the gas-operated piston (not shown) as described earlier. The cam surface 142 on the moving carrier 20 has engaged the hammer 72 and has forced the latter counterclockwise about its pin 74 to a position in which the cam surface 70 on the secondary sear 56 is in engagement with the rear cam surface 84 on the hammer 72.

As the bolt carrier 20 continues to move toward the rear from the position illustrated in FIG. 4 the cam surface 142 on the carrier 20 depresses and passes over the trigger disengagement spring 110 so that the trigger disengagement arm 98, its rod 106 and its sear 108 are rotated counterclockwise about the pin 100. The sear 108 is now in a position, as seen in FIG. 5, just above the trigger disengagement pin 116. Upon further rearward movement of the carrier 20 as shown in FIG. 5 the cam surface 142 forces the trigger depressor plate 132 down against the upper surfaces of the trigger ribs 44 and 46, thereby causing the trigger 38 and the secondary member 56 to pivot counterclockwise (forwardly) even though the operator's finger may still be exerting pressure on the projection 42. This moves the trigger disengagement pin 116 up and to the rear so that it engages in the junction between the surfaces 112 and 114 in the disengagement sear 108. The trigger 38 is now held in its counterclockwise position and cannot be pulled clockwise. The counterclockwise movement of the secondary trigger element 56 allows the hammer 72 to swing clockwise until sear surfaces 50 and 82 engage.

The bolt carrier 20 continues to move toward the rear until it strikes the rear wall 18 of the receiver 10 whereupon the return spring 30 begins to move the carrier 20 forward. During the last part of the rearward movement of the carrier 20 the spent cartridge is ejected in the conventional manner. The sear 108 remains in the down position until the carrier 20 has moved all the way forward (FIG. 1). The cam surface 104 on the carrier has now engaged the cam surface 102 on the disengagement arm 98 so as to pivot the arm 98, its rod 106 and its sear 108 clockwise to a position in which the sear 108 is out of contact with the sear pin 116. In moving forward the carrier 20 will have picked up a fresh cartridge from a magazine (not shown) fitted into a magazine opening 146 in the bottom wall 12 of the receiver 10. At this point the operator's finger pressure on the trigger projection 42 may cause the rifle to fire again.

The above-described sequence of operation provides a variable rate of fire which is responsive to the magnitude of the operator's finger pressure on the trigger projection 42. With a light finger pressure a trained operator can fire a single shot, and when the trigger projection 42 is pulled back hard the firearm will fire continuously (fully automatic) at essentially the maximum rate of the particular firearm, this being about 700 rounds per minute for an AK-47 rifle. Variable finger pressures will produce firing rates between a single shot and maximum rate. The fundamental explanation of this is that the operator's finger will, in effect or in actuality, become temporarily disengaged from the trigger when the finger pressure is less than that which will maintain maximum automatic fire rate. That is, the very rapid counterclockwise movement of the trigger 38 when the trigger depressor plate 132 is kicked down by the bolt carrier 20 is sufficient to reduce or remove finger pressure from the trigger. This delays the return of finger pressure sufficient to actuate the trigger again, even though the operator will not have relaxed his trigger finger.

Chart I illustrates the sequence of major operations which occur during one cycle of firing in a variable rate mode. For comparison purposes Chart II illustrates a cycle of conventional full automatic firing, for example, the operation of an unmodified AK-47 rifle set to operate in a fully automatic mode.

OPERATION OF THE SEMI-AUTOMATIC MODE

To operate the illustrated rifle in a semi-automatic mode the selector level 124 is moved manually to its down position. This swings the selector lug and the trigger depressor plate 132 to a position, illustrated in FIG. 6, in which the plate 132 cannot be engaged by the trigger 38. The other parts in FIG. 6 are in the same position as in FIG. 1, that is the carrier 20 and the bolt 24 are completely forward and the hammer 72 is being held in a cocked position by engagement of the sear surfaces 80 and 82. Pulling of the trigger 38 releases the hammer and fires a round but does not effect any movement of the trigger depressor plate.

Rearward movement of the carrier 20 and the bolt after a round has been fired forces the hammer 72 counterclockwise by engagement of the cam surface 142 with the front surface 78 of the hammer 72, as previously described and as illustrated in FIG. 7. The sear surface 84 on the hammer 72 now engages under the sear surface 70 on the secondary trigger member 56 so that the hammer 72 is held back by the latter even if the operator's finger is not released from the trigger. The hammer 72 is not held back in this manner in the variable rate mode, because the trigger 38 is kicked counterclockwise soon after the hammer 72 has been rotated counterclockwise. That is, in the variable rate mode, engagement of sear surfaces 84 and 70 is momentary and the holding back of the hammer 72 is immediately transferred to sear surfaces 82 and 50. Again referring to FIG. 7, when the trigger is released by the operator it will be rotated counterclockwise by the hammer and trigger spring 86 thereby releasing sear surfaces 84 and 70. The hammer 72 then moves clockwise until its sear surface 82 engages the trigger sear surface 50. The carrier 20 has by now returned to its forward position and the rifle can be fired again by pulling back on the trigger. The reciprocating movement of the carrier 20 will have actuated the arm 98, rod 106 and sear 108 thereby temporarily locking the trigger so that the hammer 72 cannot follow the carrier forward.

The variable rate firing mechanism is fail safe in the sense that failure of its parts permits operation of the rifle in the semi-automatic mode even without adjusting the position of the selector lever 124. If the trigger depressor plate 132 breaks the secondary trigger element 56 will come into operation, as described above, because the trigger 38 will not be kicked forward. In the event of the failure of the arm 98, rod 106, sear 108 or spring 110 the trigger 38 will go rearward before the bolt 24 closes past the hammer cocking point, causing the secondary trigger 56 to again come into operation. If the pin 116 becomes broken, the trigger would go rearward before the bolt 24 closes past the hammer cocking point, causing the secondary trigger element to again become operative.

It will be noted also that if the secondary trigger member 56 breaks while the selector lever 124 is in its variable fire position, the firing mechanism will continue to fire in a variable mode. That is, the hammer sear 82 will move into engagement with the trigger sear 50.

A further reliability feature of the illustrated rifle results from the multifilament wound spring 86 which is standard in the AK-47 rifle and which is resistant to breakage in cold weather. Failure of this type of spring is generally only partial in the sense that one filament will break before the next filament breaks. The remaining filament or filaments have sufficient strength to operate the trigger and hammer, and the broken filament will be detected by routine examination.

The standard AK-47 also includes a further reliability feature in that the standard primary trigger has two primary sears 48, one associated with each trigger rib 44 and 46. The standard hammer head 80 spans both sears 48 so that the hammer sear surface 82 engages both trigger sear surfaces 50. Therefore, if one side of the hammer is broken off, or if one of the trigger sears 48 fails, the remaining trigger sear 48 and its sear surface 50 will continue to cooperate with the hammer.

When it is desired to place the firing mechanism on safety the selector lever 124 is manually moved to its full up position. This swings the selector lug 118 to a position directly over the ribs 44 and 46 of the trigger 38, as illustrated in FIG. 8, so that the trigger cannot be rotated clockwise.

CHART I

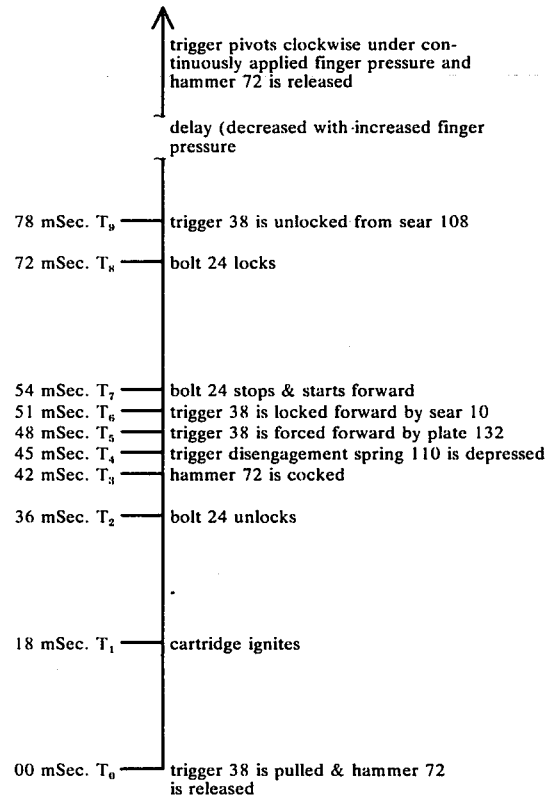

CHART II

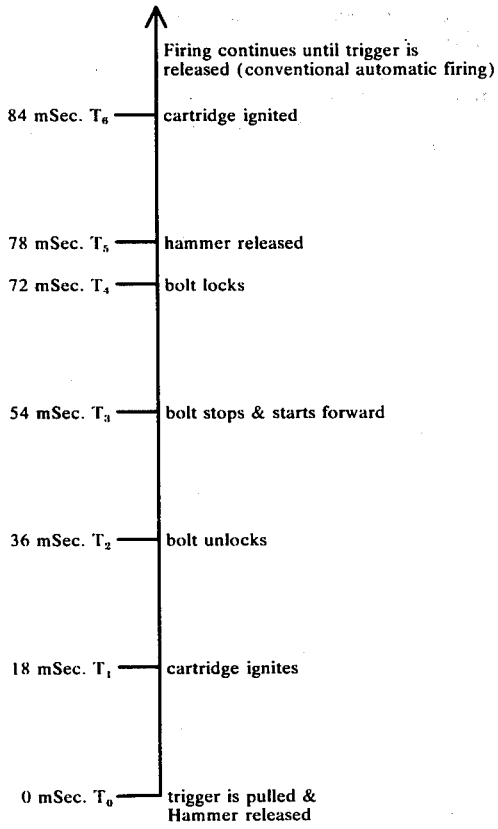

What is claimed is:

1. In a firearm firing mechanism, a trigger movable in first and second directions, a hammer which is moved to a cocked position automatically upon the firing of a round and which cooperates with said trigger so as to be released when said trigger is moved in said first direction, and means operable after said trigger has been moved in said first direction and in response to the firing of a round for rapidly and positively moving said trigger in said second direction against finger pressure being exerted on said trigger by the operator so that finger pressure on said trigger is momentarily opposed whereupon the time period before said trigger is again moved in said first direction by the operator's finger is inversely proportional to the magnitude of the operator's finger pressure on the trigger.

2. A firing mechanism as in claim 1 wherein said means for rapidly and positively moving said trigger in said second direction includes a reciprocating member operable to move through a single cycle upon firing of a cartridge and a trigger depressor member driven in response to movement of said reciprocating member for engaging and moving said trigger.

3. A firing mechanism as in claim 1 wherein said trigger is pivoted for swinging movement in said first and second directions and wherein said means for rapidly and positively moving said trigger in said second direction includes a reciprocating member operable to move through a single cycle upon firing of a cartridge, a trigger depressor member movable into the path of said reciprocating member upon swinging of said trigger in said first direction and subsequently movable upon movement of said reciprocating member to swing said trigger in said second direction.

4. In a firearm, a bolt assembly which operates automatically upon firing of a cartridge to accept a fresh cartridge; a trigger; a hammer which upon firing of a cartridge is automatically moved to a cocked position, said trigger and hammer cooperating in a manner such that while continuous finger pressure greater than a preselected value is exerted on said trigger said hammer becomes released from its cocked position after a fresh cartridge has been accepted by said bolt assembly so that said firearm will fire continuously while said finger pressure is maintained; reciprocating means forming part of said bolt assembly automatically movable in a first direction in response to firing of a cartridge and subsequently in a second direction; and means cooperating with said reciprocating means and with said trigger for delaying the release of said hammer by said trigger inversely proportional to the magnitude of finger pressure on said trigger whereby the operator of the firearm may increase and decrease the rate of fire by, respectively, increasing and decreasing his finger pressure on the trigger.

5. A firearm as in claim 4 wherein said means cooperating with said trigger includes a trigger depressor element mounted to be moved by pulling of said trigger rearwardly by the operator into the path of said reciprocating means as the latter moves in said first direction so that said trigger depressor element is struck by said reciprocating means and is forced in an opposite direction against said trigger to thereby move said trigger to a forward position, said firearm further comprising means for locking said trigger in said forward position and for unlocking said trigger during movement of said reciprocating means in said second direction.

6. A firearm as in claim 5 including a manually adjustable selector arm cooperating with said trigger depressor element to move said trigger depressor element out of the path of movement of said trigger upon movement of said selector arm to a preselected position whereby said trigger depressor element and said delaying means become non-functional.

7. A firearm as in claim 6 including a secondary element cooperating with said trigger and having a sear surface engageable with a sear surface on said hammer when said trigger depressor element is non-functional for holding said hammer back until finger pressure is released from said trigger.

8. In a firearm firing mechanism: a trigger assembly having a movable finger element for engagement by an operator's finger; a bolt assembly which moves automatically in a first direction upon firing of a cartridge and then in a second direction to accept a fresh cartridge and move the same into a firing position; a hammer assembly having a hammer element which is moved to a cocked position in response to movement of said bolt assembly in said first direction, said hammer assembly and said trigger assembly cooperating during the movements of said bolt assembly in a manner such that while continuous finger pressure greater than a preselected value is exerted by an operator on said finger element said hammer element becomes released from its cocked position after a fresh cartridge has been accepted by said bolt assembly so that the firing mechanism will operate continuously while said finger pressure is maintained on said finger element; and firing rate control means cooperating with said bolt assembly and with said trigger assembly for varying the rate of operation of said firing mechanism by delaying operation of said mechanism, after each cartridge has been fired, in an amount inversely proportional to the magnitude of finger pressure on said finger element whereby the rate of fire may be increased or decreased by the operator by increasing or decreasing, respectively, his finger pressure on said finger element.

9. A firing mechanism as in claim 8 wherein said rate control means includes trigger depressor means and trigger disengagement means operative in response to movement of said bolt assembly to move said finger element in a direction against the operator's finger pressure to a displaced position, then to hold said finger element in said displaced position against the operator's finger pressure and then to release said finger element so that it may be moved by the operator's finger pressure.

* * * * *